US005722262A

United States Patent [19]

Proctor et al.

[11] Patent Number: 5,722,262

[45] Date of Patent: Mar. 3, 1998

[54] METHOD OF KNITTING FABRIC WHERE JOINED EDGES ARE FORMED FROM SUB-EDGES OF 45° AND COURSE-WISE DIRECTIONS

[75] Inventors: Malcolm Frederick Proctor; Giles Timothy Gregory, both of Nottingham, United Kingdom; Stuart Thomas Smith, Port Huron; Gary John Leeke, Southfield, both of Mich.

[73] Assignee: General Motors Corporation, Detroi, Mich.

[21] Appl. No.: 818,479

[22] Filed: Mar. 14, 1997

Related U.S. Application Data

[62] Division of Ser. No. 591,813, Jan. 25, 1996.

[30] Foreign Application Priority Data

Feb. 1, 1995 [GB] United Kingdom ..... 9501995

[51] Int. Cl.[6] ..... D04B 7/00; A41H 3/00; A42C 1/00

[52] U.S. Cl. ..... 66/60 R; 66/64; 33/17 R

[58] Field of Search ..... 66/60 R, 64; 33/17 R

[56] References Cited

U.S. PATENT DOCUMENTS

| | | | |
|---|---|---|---|
| 2,237,144 | 4/1941 | Houseman | 66/179 |
| 2,301,468 | 11/1942 | Smetana | 66/182 |
| 2,480,894 | 9/1949 | Alric | 66/89 |
| 2,969,662 | 1/1961 | Gordon | 66/89 |
| 3,176,480 | 4/1965 | Gordon et al. | 66/189 |
| 3,500,665 | 3/1970 | Braxton et al. | 66/176 |
| 4,899,448 | 2/1990 | Huang | 33/17 R |

FOREIGN PATENT DOCUMENTS

| | | | |
|---|---|---|---|
| 556240 | 4/1957 | Belgium | 33/17 R |
| 783320 | 4/1935 | France | 33/17 R |
| 2206609 | 1/1989 | United Kingdom . | |
| 2223034 | 3/1990 | United Kingdom . | |
| 2223036 | 3/1990 | United Kingdom . | |

*Primary Examiner*—John J. Calvert

*Attorney, Agent, or Firm*—George A. Grove

[57] ABSTRACT

A continuously weft-knitted three-dimensional fabric cover having sutures to accommodate its three-dimensional format in which each suture defines a straight line or a series of straight lines joined end-to-end, each straight line lying at an angle of between 0° and 50° to the course-wise direction of the fabric.

5 Claims, 5 Drawing Sheets

METHOD OF KNITTING FABRIC WHERE JOINED EDGES ARE FORMED FROM SUB-EDGES OF 45° AND COURSE-WISE DIRECTIONS

This application is a division of Ser. No. 08/591,813 filed Jan. 25 1996.

This invention relates to a knitted fabric cover and a method of continuously knitting a fabric cover for a three-dimensional object, the whole cover being formed in a single operation requiring no further sewing or processing.

BACKGROUND OF THE INVENTION

The invention is useful in machine knitting on a weft knitting machine having independently operable needles disposed in at least two needle beds, for example, a flat V-bed machine producing a mainly double jersey structure. In such machines, the width of the knitted fabric is restricted by the maximum number of needles available for forming a course across the machine beds.

Three-dimensional fabric structures for covering three-dimensional objects are produced from two-dimensional material and have in the past been produced by weaving or knitting shaped parts and panels of said two-dimensional material and sewing them together.

More recently it has been found possible to knit one-piece upholstery fabric which removes the need for sewing portions together and has the desired shape to serve as covers for the base and back cushions for vehicle seats. A problem that has arisen with the continuous knitting of three-dimensional fabric structures is that it has hitherto been impossible to knit satisfactory joint edges where the angle between the edges-to-be-joined in the two-dimensional form exceeds 135°. Generally, the maximum angle for continuous knitting together of edges should not exceed an angle of 90° depending upon the application. Generally, the larger the angle between the edges-m-be-joined, the poorer the appearance and strength of the joint. GB-A 2,223,036 discusses in detail the problems associated with continuous knitting of edges-to-be-joined having large angles therebetween. The applicants copending application U.S. Ser. No. 08/546,261, filed Oct. 20, 1995, discloses one means for overcoming problems associated with large angles.

SUMMARY OF THE INVENTION

The invention provides for a continuous knitted three-dimensional cover and a method of knitting the same.

According to one aspect of the present invention, there is provided a weft-knitted three-dimensional fabric cover for a three-dimensional object having sutures to accommodate its three-dimensional format wherein each suture lies at an angle of at between 0° and 50° to the course-wise direction of the fabric.

preferably at least two sutures meet at a point at the edge margin of the cover and said sutures have an angle therebetween of approximately 45°. Conveniently, the point lies on or adjacent a selvedge of the fabric.

According to a further aspect of the invention, there is provided a knitting pattern for continuous knitting of a three-dimensional weft-knitted cover for a seat, the pattern having a plurality of pairs of edges-to-be-joined, wherein the edges each have a bias angle to the course-wise direction of knitting that lies between 0° and 45°.

preferably, the pattern has at least one point on at least one side selvedge margin with two edges extending away from the said point, one edge extending in a substantially course-wise direction and other edge extending at a bias of 45°, the two edges forming different sutures in the knitted cover.

Alternatively, the pattern may have at least one pair of edges to be joined, wherein each edge comprises a series of zigzag sub-edges, each sub-edge being at a 45° bias to the course-wise direction with adjacent sub-edges having different bias directions.

Yet another aspect of the invention provides a method of forming a knitting pattern for a three-dimensional knitted fabric cover having a two-dimensional development in which there is at least one pair of opposed convex curved original edges-to-be-joined together which extend away from a point of intersection and in which tangents to the curved edges increase in angle relative to the course-wise direction for knitting outwardly from said point, and where the angle between opposed tangents to points-to-be-joined on the two curved edges exceeds 90°, said method comprising forming the two-dimensional developments, determining the wale-wise direction and course-wise direction for knitting, reforming said edges-to-be-joined as new edges-to-be-joined arranged at either a 45° bias to the course-wise direction of the fabric cover, or substantially parallel to said course-wise direction.

Conveniently, in a first embodiment of the method of the invention, each edge-to-be-joined is subdivided into a series of zigzag sub-edges, each zigzag sub-edge being at a 45° bias to the course-wise direction, and the apex points at one side of the zigzag edges lie on the line of the original edge-to-be-joined.

Alternatively, in a second embodiment of the method of the invention in the development each original edge-to-be-joined terminates at a particular needle line in the wale-wise direction. Each edge is re-aligned as a first new edge along a tangent at a 45° bias to the course-wise direction extending between said needle-line and a point on the convex edge. A new course-wise edge is formed inwardly from the point of intersection between the 45° bias line and the needle line such that the course-wise edge extends across said original edge-to-be-joined by a course-wise distance substantially equal to the distance between the edge and said particular needle line.

A still further aspect of the present invention provides a method of continuously knitting a three-dimensional fabric cover, said method comprising determining the shape of a knitting pattern as described above and/or taking a knitting pattern as described above and then continuously knitting the object with said edges being joined together during the knitting operation. Such covers are particularly of use in car seat upholstery.

BRIEF DESCRIPTION OF THE DRAWINGS

The invention will be described by way of example and with reference to the accompanying drawings in which.

DESCRIPTION OF THE PREFERRED EMBODIMENT

Figure 1:
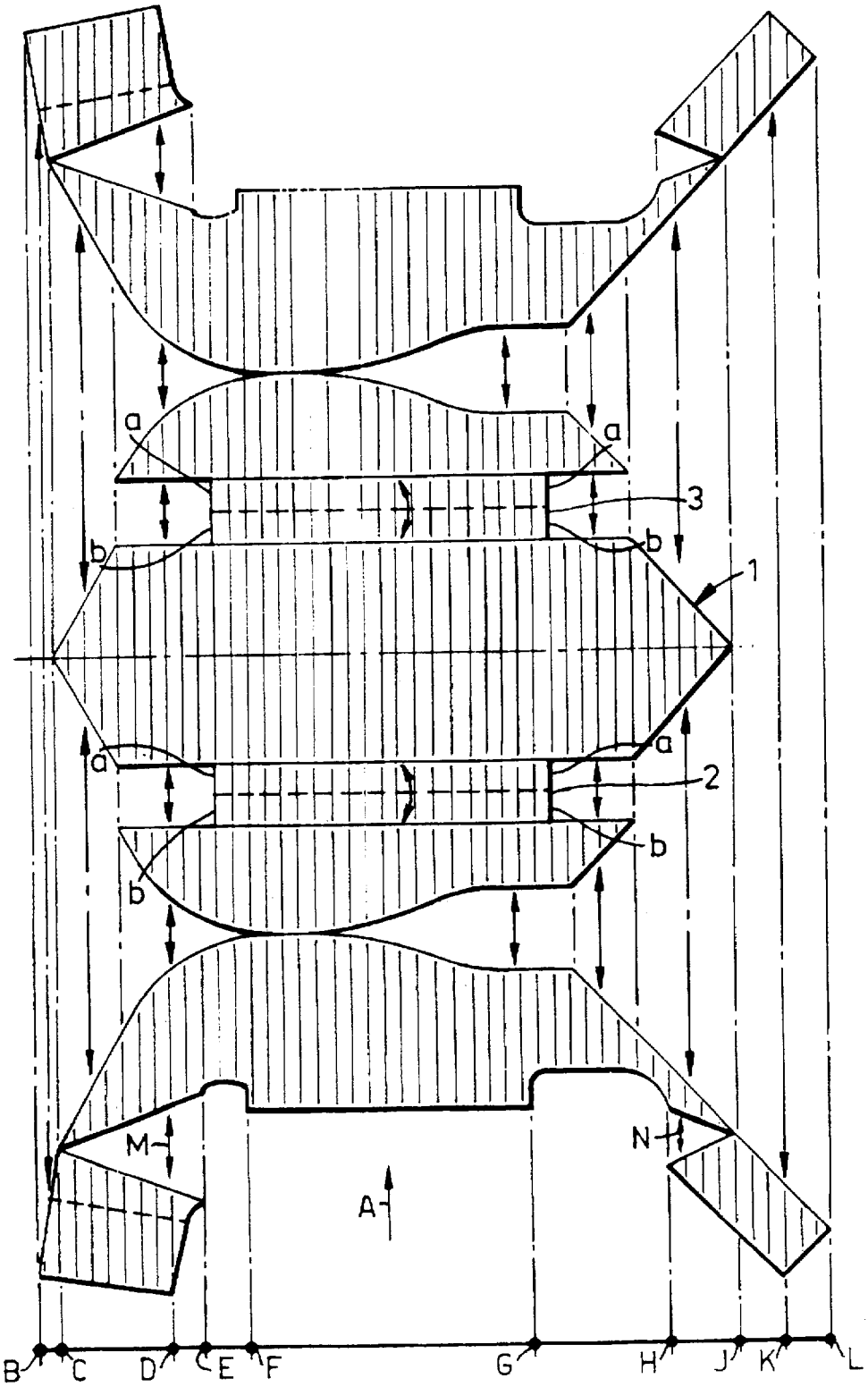
FIG. 1 shows a prior an knitting pattern.

FIG. 1 is a conventional pattern for a seat cover and which would be knitted in a similar manner to a cover described in EP-A-361,855. A fabric piece 1 for covering a seat base of an automobile seat can be continuously weft-knitted in a single operation. The fabric piece 1 is of mainly double jersey structure and is knitted on a flat V-bed knitting machine provided with a conventional presser foot device or other loop hold-down device for holding down the knitted fabric between the opposed needle beds of the machine. The direction of knitting, indicated by arrow A, is such that the wales of the fabric piece extend in a desired manner across the seat base. This may be dictated by a pattern on the fabric or by other technical considerations.

The knitting of the fabric piece 1 is described in detail in GB-A-2,223,034 and will only be further described herein so as to give background information for understanding the present invention.

In FIG. 1, the line B-L represents the length of opposed needle beds of the machine on which the piece 1 is knitted. The needles operate to form fabric along vertical lines only (that is, in wales). Essentially, the knitting begins on a few needles at point D on the needle bed, and more needles are brought progressively into action course-by-wale in the direction from D-B and from D-E to begin to define the edges of the material. Similarly, knitting will commence at point K with needles being brought progressively into action from K-H and from K-L. The needles are then made progressively active and/or inactive in order to obtain the required shape of the fabric.

During the continuous knitting operation from bottom to top of the fabric, edges of the fabric between which double-ended arrows are located are knitted together. Taking the two edges indicated by double-headed arrows M and N, for example, this requires that needles made inactive between the point C and E, and H and J, respectively, are progressively reactivated to "join" the two edges indicated by M and N along vertical lines.

Integral open-ended loops may be formed by knitting areas 2 and 3 on one needle bed only. Alternatively, the areas 2 and 3 are utilized by folding along the dotted lines for forming open ended loops beneath the seat cover for facilitating incorporation of the cover into a seat.

Figure 2:
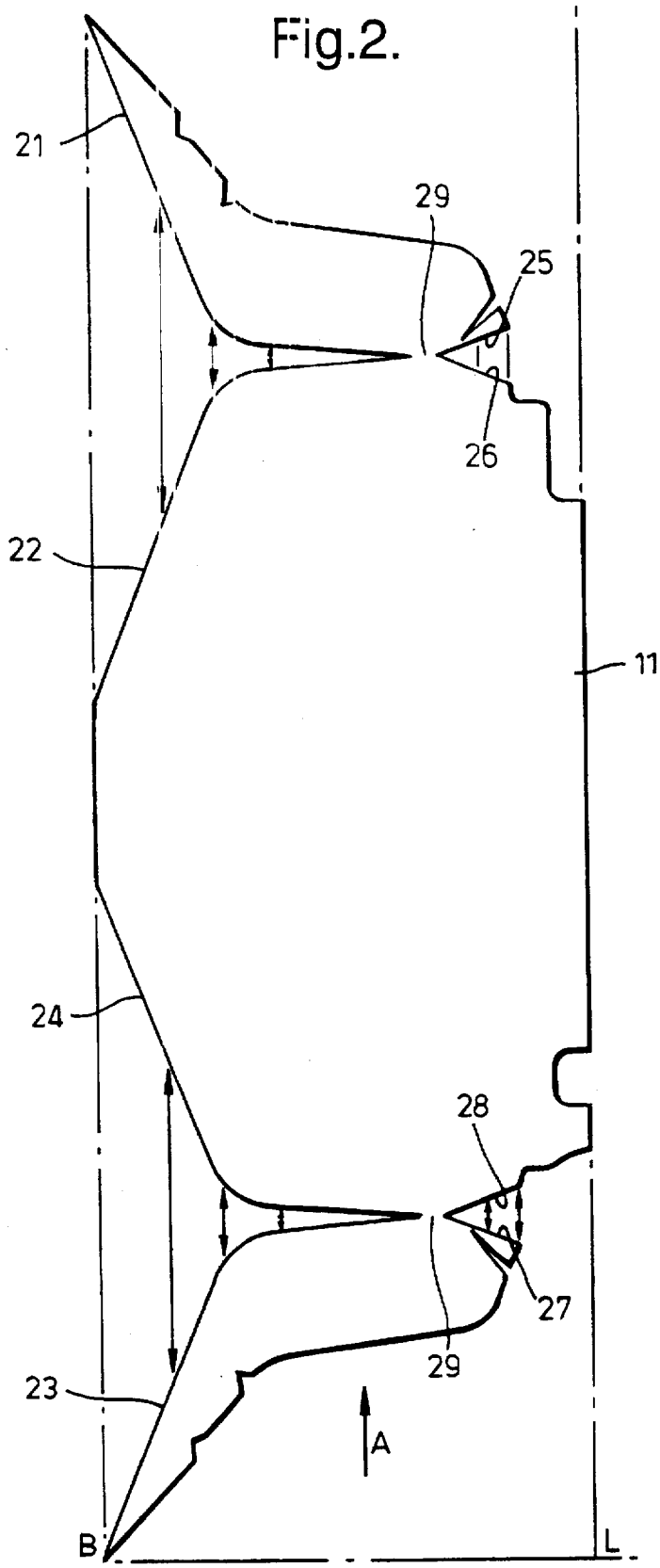
FIG. 2 shows a conventional knitting pattern.

Referring to FIG. 2, there is illustrated a conventional knitting pattern 11 for an automobile seat base cover which is knitted with its wale-wise direction in the direction of arrow A. The pattern is basically a two-dimensional development of the base cover. The course-wise extent of the pattern is set by the needle lines B and L. It will be readily apparent that during knitting only those points that lie on a vertical line (a needle line) can be integrally joined. The pairs of edges-to-be-joined 21 to 22, 23 to 24, 25 to 26, and 27 to 28 are again shown by double-headed arrows.

The two pairs of edges-to-be-joined 25,26, and 27,28 have horizontally equally bisected angles therebetween which are each equal to about 45° This is a preferred arrangement for joining of edges as is described in copending U.S. Ser. No. 08/546,261, filed Oct. 20, 1995. The other two pairs of edges-to-be-joined 21,22 and 23,24 again have horizontally equally bisected angles, but the edges are curved with the angle between opposing parts to be joined changing so that it increases outwardly from a crutch 29 of the join being about 10° at the crutch 29 and increasing to about 140° adjacent the outer needle line B. Therefore, in the pattern as shown in FIG. 2, the suture for the joints between the edges 21,22 and 23,24 will be difficult to mask since it will be present in the front panel 102 of the seat (see FIG. 6) and will be immediately apparent on initial view.

Figure 3:
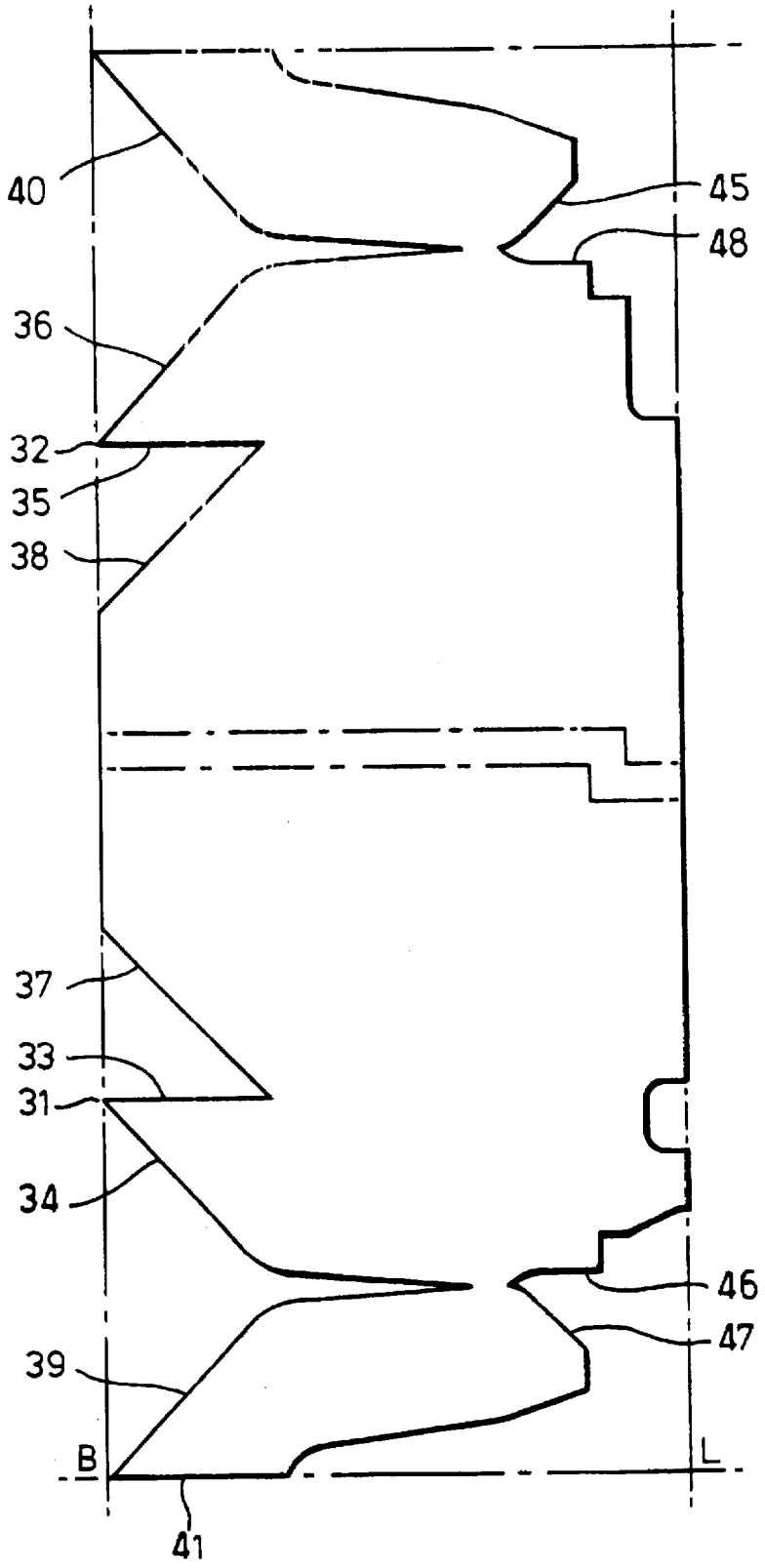
FIG. 3 shows a first knitting pattern according to the present invention.
Figure 4:
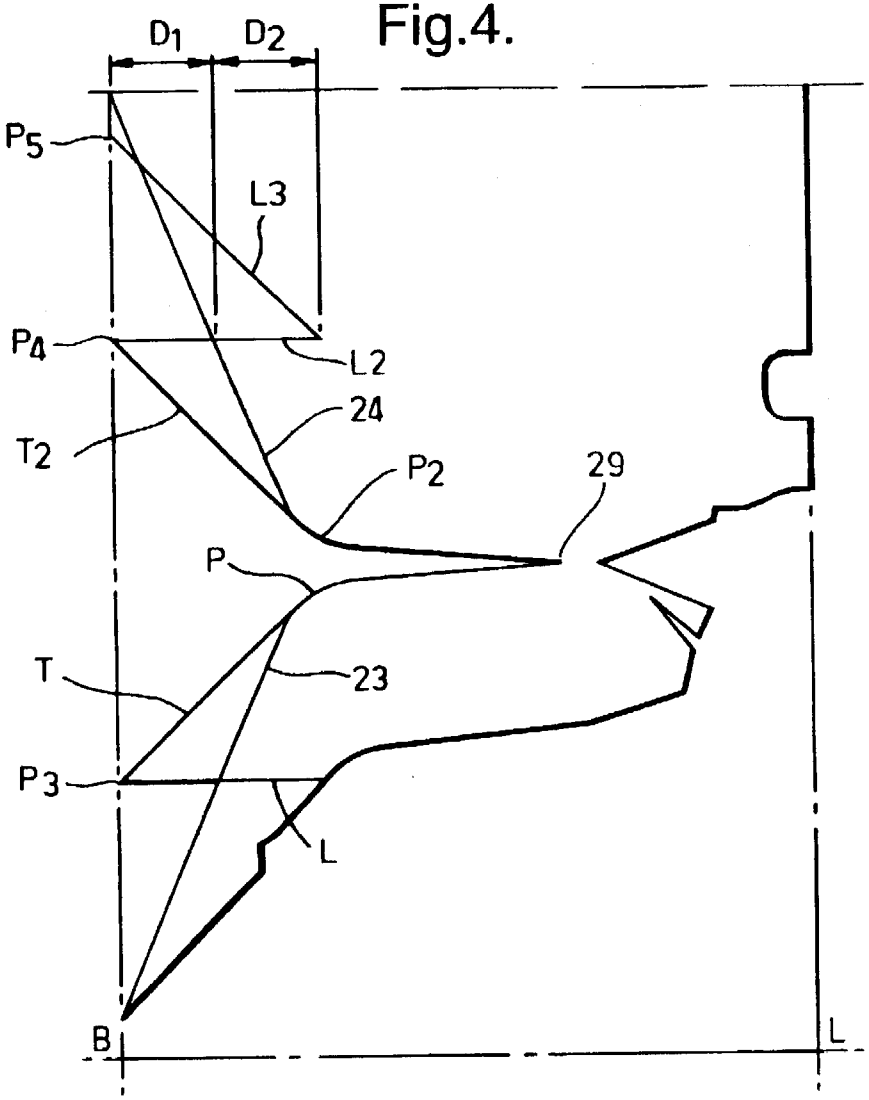

According to one aspect of the present invention, the conventional pattern shown in FIG. 2 and partially in FIG. 4 can be rearranged to the form shown in FIG. 3. In the rearranged state, most of the original edges-to-be-joined have been reformed so that edges-to-be-joined have a bias angle to the course-wise direction of knitting that lies between 0° and 45°. An angle of up to 45° to the course-wise direction gives acceptable join characteristics in that during the knitting process the needles along the suture will hold no more or no less than two loops when compared with the preceding active neighboring needle, depending upon the knitted structure.

The left lateral edge of the pattern along needle line B in FIG. 3 now has a pair of spaced points 31,32 located along the needle line B on the lateral edge or immediately adjacent the edge (that is, within one or two needles) with two edges 33,34 and 35,36, respectively, extending away from each point, one edge 33 or 35 being substantially in a course-wise direction, and the other edge 34 or 36 being biased at 45° to the course-wise direction.

The course-wise edges 33,35 each intersect with a second 45° bias edge 37,38, respectively, parallel to the other edge 34,36. The edges 21 and 23 have been reformed on an opposite 45° bias as edges 39 and 40.

The right lateral edge margin of the fabric in FIG. 3 has also been rearranged so that the edges 25 and 27 in FIG. 2 have been altered to edges 45 and 47 in FIG. 3 with a 45° angle bias, and the edges 26 and 28 in FIG. 2 have been altered to course-wise edges 46 and 48 in FIG. 3, with necessary adjustments to the lateral edges of the pattern.

The rearrangement to the left lateral edge margin of the pattern shown in FIG. 3 is determined from the shape of the original development as shown in FIG. 4. For the sake of simplicity, only a lower pan of the development is shown, but the same technique is applied to the upper part of the development as shown in FIG. 2. A tangent line T is drawn at a 45° bias to the course-wise direction between the needle line B and a point p on the convex edge 23, the point P being the only point to which a 45° tangent T can be drawn. A course-wise line L is drawn from the intersection point $P_3$ of the tangent T and the needle line B across the development.

Figure 5:
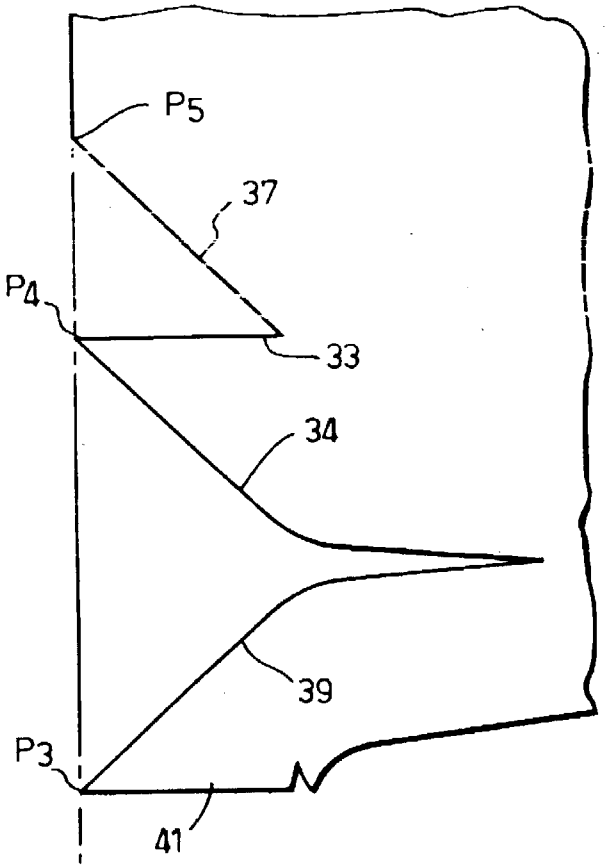
FIGS. 4 and 5 are enlargements of portions of FIGS. 2 and 3, respectively, showing how the pattern according to the invention is derived from the conventional pattern.

Since the added area within the lines T and L is substantially equal to the now excluded area below the line L, the line T becomes the edge 39 of FIG. 3 and FIG. 5, and the line L becomes the new set up edge 41 of the final pattern (FIG. 3).

Similarly, a second tangent line $T_2$ is drawn at an opposite bias of 45° to the course-wise direction between the needle-line B and a point $P_2$on the convex curved edge 24. A course-wise line $L_2$ extends inwardly from a point $P_4$ at the intersection of the tangent $T_2$ with the needle line B, such that the line $L_2$ extends inwardly beyond the edge of the pattern by a course-wise distance equal to the distance between the needle-line B and the edge 24, such that $D_1$ equals $D_2$ as shown.

Since the point $P_4$, is in alignment with a point only midway along the length of the curved edge 24, it is necessary to repeat the above procedure. Another 45° bias line $L_3$ is drawn from the inboard end of the line $L_2$ to the intersection with the needle line B at point $P_5$.

Since $P_5$ substantially coincides with the original end of the edge 24, there is no further need to repeat the procedure. In some cases, it is thought that up to three pairs of 45° biased edges and course-wise edges meeting at points on the needle-line B may be generated in reforming an original edge. The tangent $T_2$ and lines $L_2$ and $L_3$ become the edges 34.33 and 37 respectively in FIGS. 3 and 5.

The areas of the original development that have been excluded are substantially balanced by the areas added. Since the wale-wise length of the pattern has been reduced, there is a saving in knitting time. Further, since all the joins are pairs of edges having bisected angles therebetween of up to 90° and pairs of edges having angles therebetween of 45° or less, then the sutures created by these joins will be practically invisible. Any slight reduction in lengths in the three-dimensional form after knitting are accommodated by the natural give in the knitted fabric.

Figure 6:
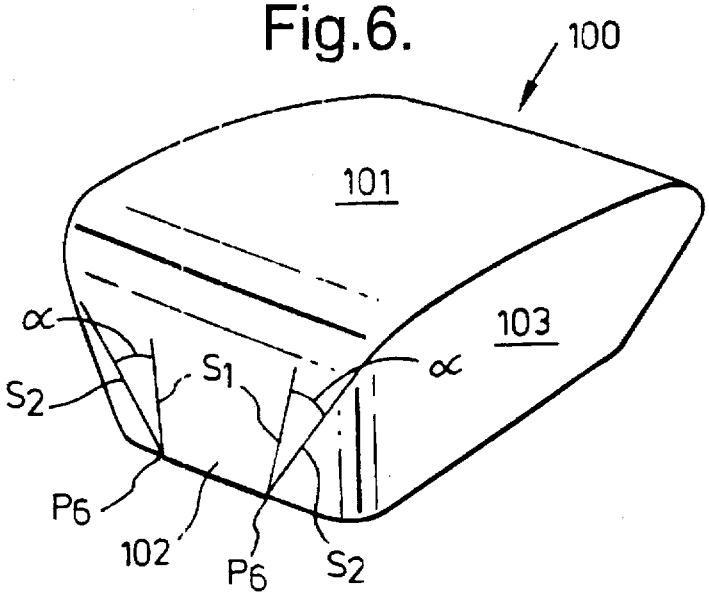
FIG. 6 is a sketch of a cover formed from the knitting pattern of FIG. 3.

A fabric weft-knitted seat cover 100 is shown in FIG. 6. The seat has an upper surface 101 with a front face 102 and side faces 103 which are substantially normal to each other. The seat cover 100 will be continuously knitted from the pattern shown in FIG. 3 as previously described with reference to FIG. 1 to form a three-dimensional seat cover from the two-dimensional pattern merely by knitting together the edges of the flat areas during the knitting process. The seat cover will have sutures $S_1$ and $S_2$ which will have approximately a 45° bias to the course-wise direction of the fabric and, allowing for some distortion on fitting on the seat, should not exceed a bias of 50°. The points $P_3$, $P_4$ and $P_5$ in FIG. 5 will all come together at a single point $P_6$ on the selvedge of the knitted article, which will have a pair of suture lines $S_1$, $S_2$ extending away from the point $P_6$ with an angle g of about 45° therebetween. The original sutures have been moved away from the mid-front face 102 of the seat to a less visible location nearer to the sides.

Yet another approach to successfully closing large angle gaps with sutures so that they cannot easily by detected by the eye is illustrated with reference to FIGS. 7 and 8.

In a seat back cover development (not shown), a pair of edges to be joined may extend away from each other at a bias angle of say 70°. Forming an acceptable suture between these edges may be difficult. According to a second aspect of the present invention, these edges are rearranged as is described below.

Figure 7:
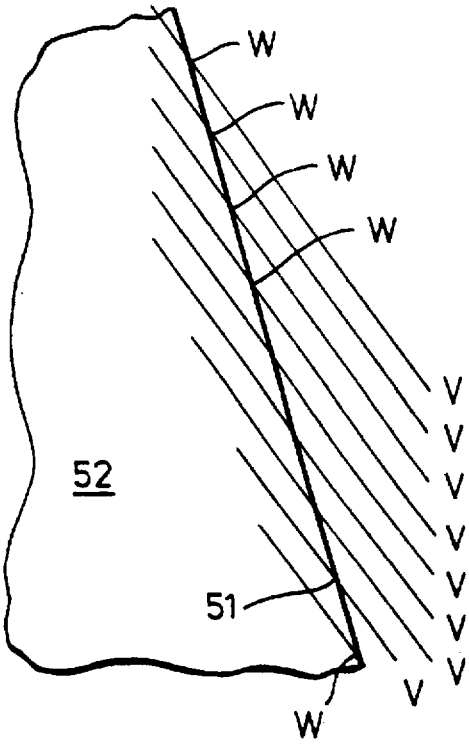
FIG. 7 is a portion of an edge-to-be-joined of a conventional knitting pattern.
Figure 8:
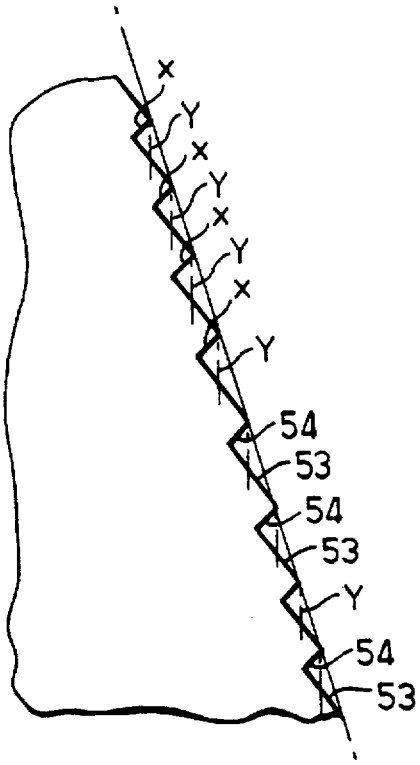
FIG. 8 is a portion of the edge-to-be-joined as shown in FIG. 7 when rearranged according to a second embodiment of the invention.

FIGS. 7 and 8 show only a portion of a high angle edge-to-be-joined 51 on a portion of weft-knitted fabric 52. The other edge (not shown) to which the edge 51 will be joined is opposite thereto and will be treated in a similar manner.

Firstly, a series of parallel equally-spaced first lines V biased at 45° to the course-wise direction of the fabric are drawn across the edge margin adjacent the edge 51. This is shown in FIG. 7, with the lines V intersecting the edge 51 at intersections W.

Thereafter, there are two possible approaches, either (i) a series of lines x on the opposite 45° bias to the lines V are drawn on the fabric 52 from intersections W of each first line V with the edge 51 to meet the adjacent first line V, or (ii) a series of vertical lines are drawn on the fabric pattern from the point of intersection W of each first line V with edge 51 to the adjacent first 45° bias line to form vertical faces Y. Each vertical face Y is transposed into a notch having two faces 53.54 each biased at 45° to the course-wise direction at opposite bias directions. The net result is the same as for (i) above.

These portions of the development formed between pairs of adjacent intersection points W and bounded by the edge 51 and the two 45° bias lines (corresponding with faces 53, 54) is removed forming zigzag sub-edges so that the sub-edges to be knitted are all at a 45° bias to the course-wise direction with adjacent edges being in opposite bias directions. The pattern will then have edges as shown in FIG. 8.

The matching portions of the opposite edge-to-be-joined (not shown) will be treated in a like manner.

When knitting, the lower edge-to-be-joined (that is, the edge nearer the set up course) the shorter sub-edges on one 45° bias will be knitted to the longer sub-edges forming a serpentine edge before the lower edge is continued into the upper edge.

The serpentine peaks created at the intersection points W on one edge will match with the "valleys" in the other edge, when the edges are joined by continuously knitting through.

A fabric having a pattern with at least one pair of edges-to-be-joined as described above can be continuously knitted on a machine as described above.

When a three-dimensional cover having edges as described with reference to FIG. 8 is knitted, it will have a serpentine suture which if examined closely will be constituted by a series of zigzag suture legs, each leg being biased at approximately 45° to the course-wise direction of the knitted fabric. The legs of the zigzag extending in one direction will all have the same length, but those extending in the opposite direction will have various lengths.

While this invention has been described in terms of certain preferred embodiments thereof, it will be appreciated that other forms could readily be adapted by one skilled in the art. Accordingly, the scope of this invention is to be considered limited only by the following claims.

What is claimed is:

1. A method of forming a knitting pattern for a three-dimensional knitted fabric cover, said knitted fabric cover to have as knitted, a horizontal course-wise direction and needle loops of yarn, extending in needle lines in a vertical wale-wise direction), with respect to said course-wise direction, said fabric cover having a two-dimensional development in which there is at least one pair of opposed convex curved original edges-to-be-joined together which extend away from a point of intersection and in which tangents to the curved edge increase in angle relative to the course-wise direction for knitting outwardly from said point and where the angle between opposed tangents to points-to-be-joined on the two curved edges exceeds 90°, said method comprising forming a two-dimensional development, determining the wale-wise direction and the course-wise direction for knitting, reforming said edges-to-be-joined as new edges-to-be-joined arranged at either 45° bias to the course-wise direction of the fabric cover, or substatntially parallel to said course-wise direction.

2. A method as claimed in claim 1 wherein each edge-to-be-joined is sub-divided into a series of zigzag sub-edges, each zigzag sub-edge being at a 45° bias to the course-wise direction, and apex points at one side of the zigzag edges lie on line of the original edge-to-be-joined.

3. A method as claimed in claim 2 wherein each edge margin is superimposed by uniformly spaced parallel lines at a first 45° bias to the course-wise direction, and at the point of intersection of each respective line with the edge, a line at 45° in an opposite bias is superimposed to intersect an adjacent uniformly spaced first 45° bias line and areas bounded by the edge and the pairs of intersecting 45° bias lines are removed from between the intersection points along the edge.

4. A method as claimed in claim 1 in which each original edge-to-be joined terminates at a particular needle line extending in the wale-wise direction, and wherein each edge is re-aligned as a first new edge along a tangent at a 45° bias to the course-wise direction, extending between said needle-line and a point on a convex edge, and a new course-wise second edge is formed from a point of intersection of the 45° bias first edge with the needle-line inwardly thereof such that the course-wise second edge extends across said original edge-to-be-joined by a course-wise distance substantially equal to a distance between the edge and the particular needle line.

5. A method as claimed in claim 4 whereto at least one of the convex curved edges is of a length which requires at least a second new 45° bias first edge to be created which extends from a inner end of the new course-wise second edge to the particular needle line.

* * * * *